US005350308A

United States Patent [19]

Laska et al.

[11] Patent Number: 5,350,308

[45] Date of Patent: Sep. 27, 1994

[54] ELASTOMERIC ELECTRICAL CONNECTOR

[75] Inventors: Joseph E. Laska, Warrington; John T. Oakley, Richboro; Francis R. Reinert, Wycombe, all of Pa.

[73] Assignee: The United States of America as represented by the Secretary of the Navy, Washington, D.C.

[21] Appl. No.: 107,431

[22] Filed: Aug. 16, 1993

[51] Int. Cl.[5] ..... H01R 13/00

[52] U.S. Cl. ..... 439/91; 439/154; 439/258

[58] Field of Search ..... 439/66, 91, 155, 154, 439/152, 158, 153, 258

[56] References Cited

U.S. PATENT DOCUMENTS

| | | | |
|---|---|---|---|
| 3,324,445 | 6/1967 | Miller | 439/66 X |
| 3,862,790 | 1/1975 | Davies et al. | 439/66 |
| 4,808,112 | 2/1989 | Wood et al. | 439/66 |
| 4,927,368 | 5/1990 | Shino | 439/66 |
| 5,101,553 | 4/1992 | Carey et al. | 439/91 X |
| 5,122,067 | 6/1992 | Sunne | 439/91 |

FOREIGN PATENT DOCUMENTS

| | | | |
|---|---|---|---|
| 308980 | 3/1989 | European Pat. Off. | 439/66 |

OTHER PUBLICATIONS

"A Simpler Way to Mount High-Pin-Count Modules" Rogers Corp. Reprint From *Electronics* Nov. 1986 copy in 439-66.

*Primary Examiner*—William Briggs

*Attorney, Agent, or Firm*—James V. Tura; James B. Bechtel; Susan E. Verona

[57] ABSTRACT

An elastic device that provides solderless, pressure contact, electrical connections between leads or leads and terminals at an interface. The elastic device comprises elastomeric material, such as silicone rubber, and has electrical conductive, compressible wires formed of a metal, such as monel, embedded in the silicone. The elastic device is particularly suited to provide electrical connections between an interface that is brought together by a connector and which is separable in response to an impulse that may be created by an explosion produced by a pyrotechnic device.

9 Claims, 3 Drawing Sheets

ELASTOMERIC ELECTRICAL CONNECTOR

The invention described herein, may be manufactured and used by and for the Government of the United States of America for governmental purposes without the payment of any royalty thereon or therefore.

BACKGROUND OF THE INVENTION

The present invention relates to an electrical connector that is separable in response to an impulse, and more particularly, to a separable elastomeric connector with a plurality of conductive members and that provides solderless electrical connections between terminals at an interface.

Electrical connections between terminals that are provided by solderless, pressure contacts are well known. These solderless connectors commonly find use in mating electrical interfaces that are frequently brought together and then frequently separated. For such applications, the reliability of the connector and the quality, that is the low resistance, of the mating surfaces are both important factors.

These connectors that use pressure contacts to establish electrical continuity may also find use in quick disconnect applications that respond to an external stimuli, such as an impulse, created by an explosion produced by a pyrotechnic device. For such applications, a connector may be located on a carrier, and when the connector if separated, a dispensable device is released. The connectors used for such applications should be reliable and should operate successfully in the presence of the contaminates, such as smoke, that may be created by the pyrotechnic device.

For such applications, the pressure contact connectors may comprise springs activated, pointed, pressure pins that are mounted on the carrier from which the dispensable device is released. These pressure pins come into contact with conductive annular rings at the base of the dispensable device and make electrical contact therewith. The use of pressure pins have several drawbacks which are as follows: a) the pins are fragile and subject to damage caused by normal handling; b) the pins are prone to failure when subjected to vibration encountered in normal operations in an aircraft where the pins and the dispensable devices are normally used; c) the pins are unreliable in the presence of contaminates normally found on printed wire board (PWB) and which contaminates are typically present during operational conditions; and, most importantly, d) the pins are the most unreliable components in the interface even though the pins are used repeatedly and even though the dispensable device is only used once. It is desired that pressure contact connectors be provided that do not suffer from the drawbacks of pressure pins. Further, it is desired that pressure contact connectors be reliable in their operation and be economical in their fabrication.

SUMMARY OF THE INVENTION

The present invention is directed to pressure contact connectors having internal means that provides for reliable mating, and good electrical conductivity, between electrical terminals at an interface. The pressure contact connector of the present invention, is a separable connector and provides solderless, electrical connections between first and second electrical equipments.

The separable connector comprises an elastic device having a plurality of compressible electrically conductive wires that are embedded in the elastic material and that are spaced apart from each other by a predetermined distance. The separable connector further comprises means for holding and compressing together first and second plates respectively carrying electrical terminals of the first and second electrical equipments.

Accordingly, is an object of the present invention to provide a pressure contact connector which brings together and provides good electrical contact between terminals of electrical equipments.

It is a further object of the present invention to provide a pressure contact connector that is reliably operated when used in quick-disconnect applications and that responds to an impulse created by a pyrotechnic device.

Still further, it is an object of the present invention to provide for a pressure contact connector that may be repeatedly separated and brought back together while still preforming reliably and providing low resistance paths between the associated electrical terminals.

Other objects, advantages and novel features of the invention will be apparent from the following detailed description when considered in conjunction with the accompanying drawings therein.

DETAILED DESCRIPTION OF THE PREFERRED EMBODIMENTS

Figure 1:
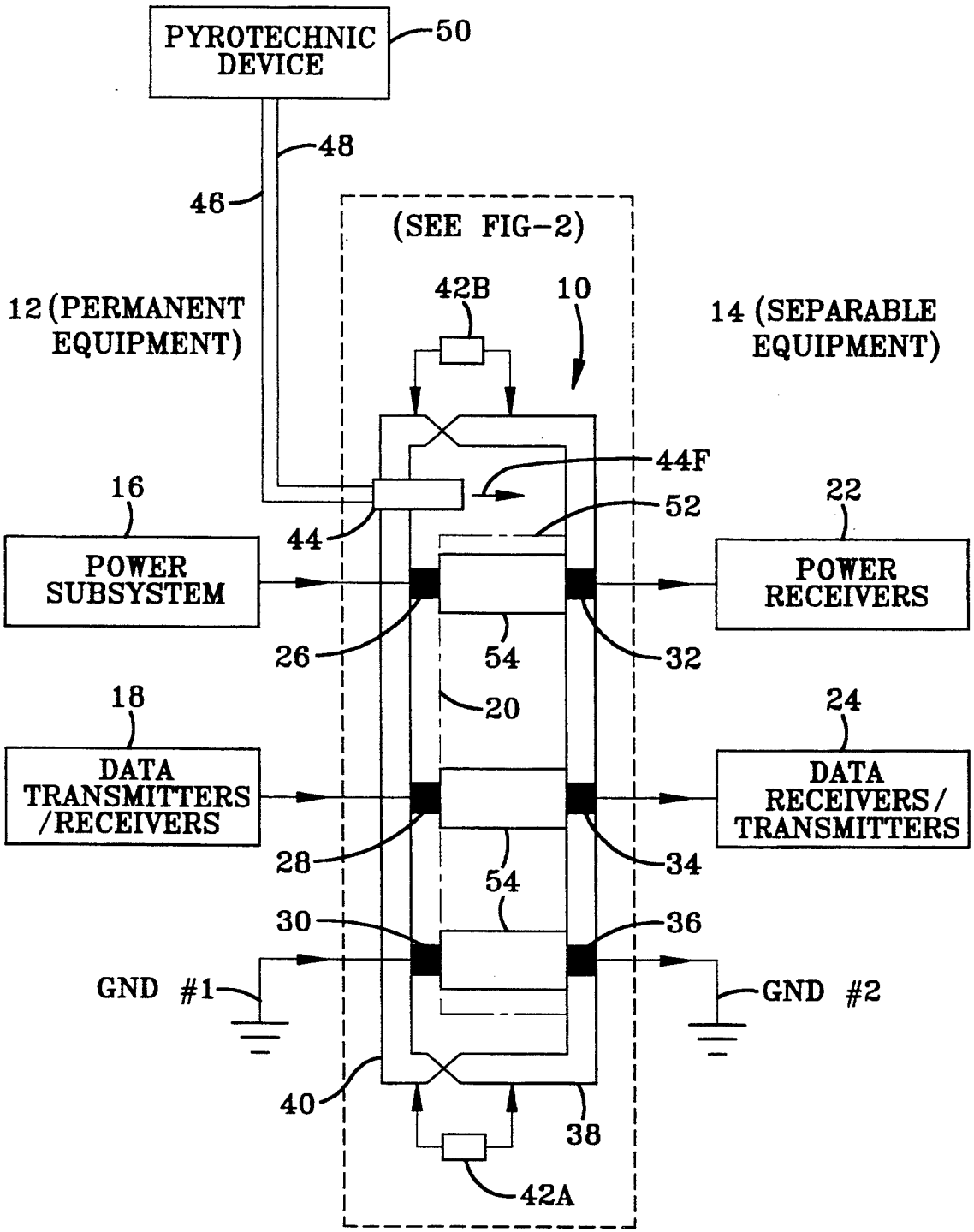
FIG. 1 is a schematic illustration showing the primary elements associated with the present invention.

With reference to the drawings, wherein the same reference numbers are used to indicate the same elements, FIG. 1 is a schematic showing the principal elements associated with the present invention, and in particular shows a separable connector 10 that provides solderless electrical connections between first and second electrical equipments, such as permanent equipment 12 and separable, and sometimes dispensable, equipment 14. The permanent equipment 12 may be usable over and over, whereas the separable, dispensable equipment 14 may be expendable such as a countermeasuring device that is releasable or expelled from airborne vehicles. The permanent equipment 12 may comprise a power sub-system 16 and data transmitters/-receivers 18 generating digital information and wherein both elements 16 and 18 have a common ground potential (GND#1). The power and data signals from the permanent equipment 12 as well as its ground GND #1 are brought out to an interface 20, where they are electrically connected by the separable connector 10 to power receivers 22, data receivers/transmitters 24 and ground potential (GND #2), respectively. The power, data and ground from the equipment 10 is respectively brought out to electrical terminals 26, 28, and 30 whereby the separable connector 10 electrically connects such terminals to terminals 32, 34 and 36, respectively, of the separable equipment 14.

The solderless separable equipment 10 comprises a first housing 38 lodging electrical terminals 32, 34, 36, and a second housing 40 lodging electrical terminals 26, 28 and 30. The first and second housings 38 and 40 are held and compressed together by appropriate means 42A and 42B. These means 42A and 42B may be of any appropriate clamping/spring arrangement known in the art and in one application of the present invention is responsive to an impulse cartridge 44. The impulse cartridge 44 in turn is responsive to an appropriate signal applied to its inputs 46 and 48 typically developed by a pyrotechnic device 50.

The pyrotechnic device 50 may produce an explosion which is sensed by the impulse cartridge 44 which, in turn, produces an outward driving force 44F which causes the connector 10 to be separated, so that the first housing 38 is expelled along with the separable equipment 14, whereas the second housing 40 remains with the permanent equipment 12. Before such separation, the electrical continuity at the interface 20 between the permanent and separable equipments 12 and 14 is maintained by a elastic device 52 having a plurality of compressible wires 54 each oriented perpendicular to the mating surface of the respective terminals 26, 28, 30, 32, 34 and 36. The elastic device 52 may be further described with reference to FIG. 2.

Figure 2A:
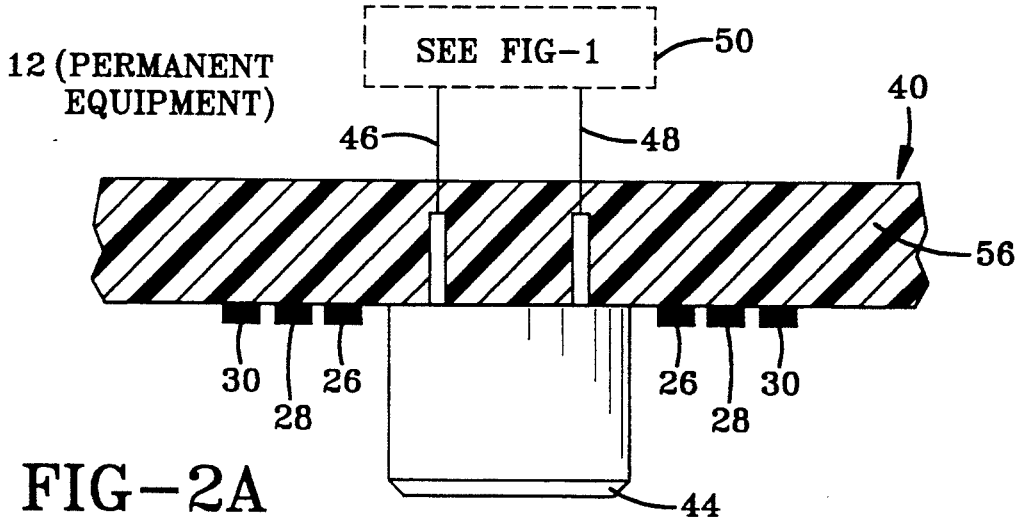
FIGS. 2A,2B and 2C, show further details of the separable connector shown in FIG. 1.
Figure 2B:
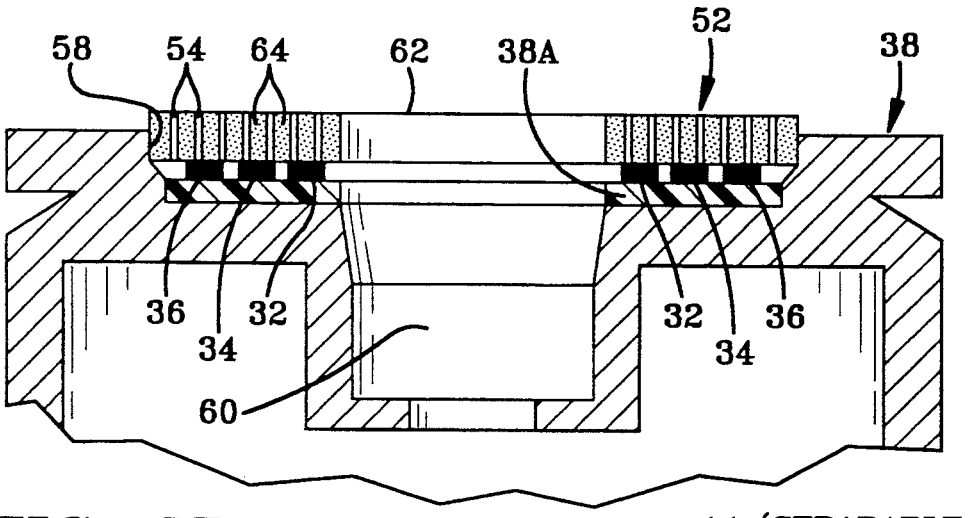
Figure 2C:
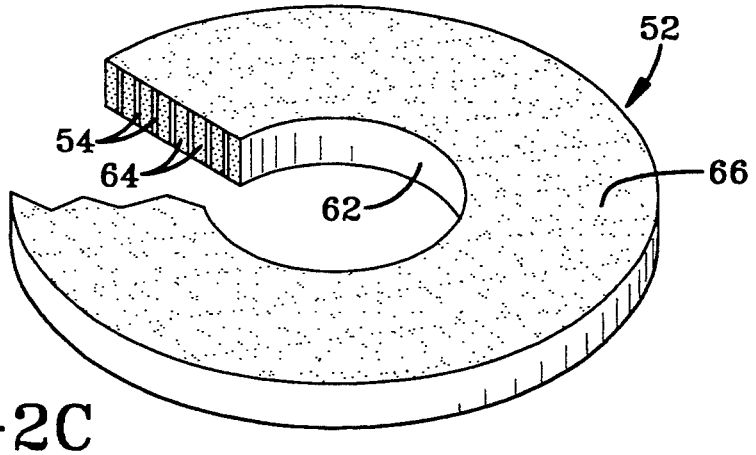

FIG. 2 is composed of FIG. 2A, FIG. 2B, and FIG. 2C, respectively showing further details of the second housing 40 of the permanent equipment 12, first housing 38 of the separable equipment 14, and the elastic device 52. The second housing 40 comprises a printed wiring board 56 that carries the terminals 26, 28 and 30 as well as having provisions lodging the impulse cartridge 44. The first housing 38 has a printed circuit board 38A, sometimes referred to as a trace, that carries the terminals 32, 34 and 36. The terminals 26, 28 and 30 as well as terminals 32, 34 and 36 are preferably annular or concentric terminals that are disposed about a respective central region and wherein the concentric terminals of printed wiring board (PWB) 56 are in alignment with the concentric terminals of the printed wiring board 38A. The separate connector 10 has appropriate means, such as a releasable clip/strap (not shown) so that the terminals, in the form of concentric rings, of the printed wiring board/or plate 38A are in alignment with the concentric terminals of the printed wiring board 56.

The housing 38 has a first cutout 58 having dimensions sufficient enough so as to accommodate the receiving of the elastic device 52 when it is so inserted. The housing 38 has a second cutout 60 and the elastic device 52 has a cutout 62, with each of the cutouts 60 and 62 having dimensions so as to accommodate the insertion of the impulse cartridge 44 into the second cutout 60. The elastic device 52 comprises the compressible wires 54 that are spaced apart from each other by a predetermined dimension 64. The elastic device 52 may be further described with reference to FIG. 2C.

The elastic device 52, serving as a pressure contact connection, preferably comprises a silicone rubber having a hardness of about 30–40 as measured on a durometer. The elastomeric device 52 provides a plurality of electrical paths for the power, data, and ground functions between the first and second equipments 12 and 14. The elastomeric member 52 has embedded therein a plurality of wires 54 preferably formed of a monel wire and having a typical diameter of about 0.004 inches. The wires 54 are separated from each other by a spacing 64 having a typical value of about 0.035 inches and, preferably, there are about 750–900 wires per square inches embedded in the silicon. Each such wire 54 provides an independent current path, and because of the large number of wires very low resistance and very high reliable paths are provided for the mated interface. The low resistance or high continuity of these paths is dependent upon the compressibility to which the wires 54 are subjected and may be further described with reference to FIG. 3.

Figure 3:
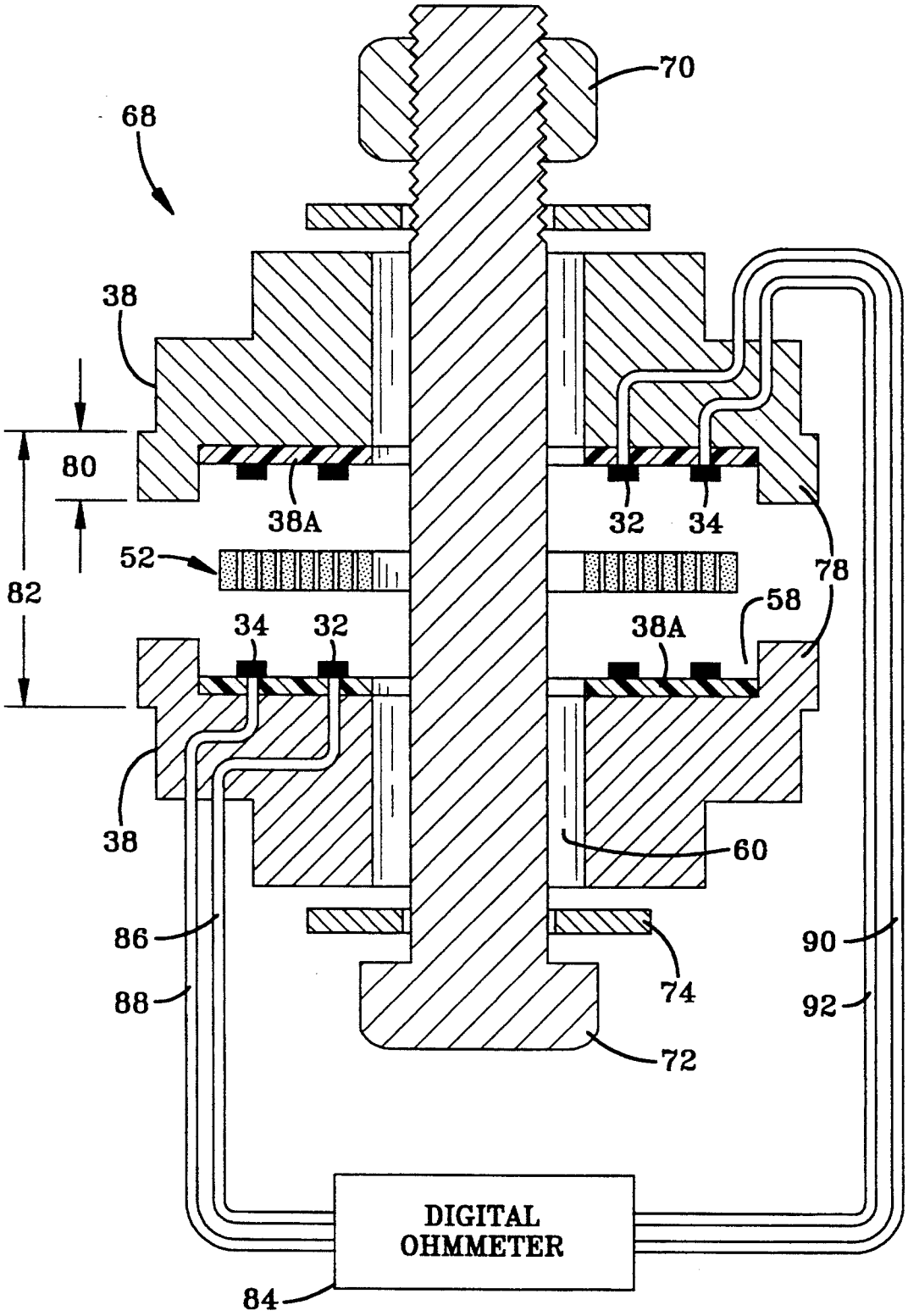
FIG. 3 is a illustration of an arrangement involved in the testing verifying the practice of the present invention.

FIG. 3 illustrates a fixture 68 that was used for the bread-broad testing to evaluate the performance of the elastomeric member 52 in the presence of simulated contamination which might occur when the separable connector 10 is responsive to its impulse cartridge 44 which, in turn, is responsive to a pyrotechnic device 50. It should be noted that the testing was performed to measure the quality, in terms of the resistance, of the electrical connections provided between terminals 32 and 34 which interconnect the power and data functions of the related interface 20, whereas terminal 36 which interconnects the ground function of the related interface 20 was not included in the test fixture. However, the non-inclusion of terminal 36 did not degrade the results obtained from the testing to be described.

The test fixture 68 comprises a nut 70, a bolt 72 and a clamp 74 which were used in combination to adjust the amount of compression that the elastic device 52 was subjected. Test fixture 68 further comprises two first housings 38 each having a cutout 58 therein. Each of the housings 38 have a lip 78 that has a thickness 80 with a typical dimension of about 0.068 inches. The fixture 68 allowed each of the housings 38 to be separated from each other, so as to provide an adjustable distance 82, used for measuring the quality, in terms of electrical resistance, of the electrical paths provided by the elastomeric member 52. The quality of this measurement was determined by a digital ohmmeter 84 having appropriate leads 86, 88, 90 and 92 respectively connected, as shown in FIG. 3, to the terminals 32 and 34 of one housing 38 and the terminals 32 and 34 of another housing 38.

Two test runs were performed using the test fixture 68, the first one was done to collect reference data under clean conditions and the second was done to collect data to measure the capability of the elastomeric member 52 to penetrate simulated contamination. For the second run, the printed wiring board 38A of each housing 38 were conformal coated with a Humiseal type 1B73. The results of both test runs are shown in Table 1:

TABLE 1

| ELASTOMERIC MEMBER 52 | | | |
|---|---|---|---|
| "82" Dimension Inches | Compression Percent | Resistance Ohms | Remarks |
| Run 1 | | | |
| .180–.218 | 0.0 | <0.00 | Nut and Bolt (70 & 72) - Arrangement Finger Tight. |
| .174–.212 | 4.8 | <0.00 | No shorts between terminals 32 and 34 |
| .160–.192 | 16.0 | <0.00 | No shorts between terminals 32 and 34 |
| .156–.180 | 19.2 | <0.00 | No shorts between terminals 32 and 34 |
| .148–.168 | 25.6 | <0.00 | No shorts between terminals 32 and 34 |
| Run 2 | | | |
| .181–.198 | 0.0 | <0.00 | Nut and Bolt (70 & 72) - Arrangement Finger Tight. |
| .162–.174 | 15.2 | <0.00 | No shorts between terminals 32 and 34 |
| .149–.164 | 25.6 | <0.00 | No shorts between terminals 32 and 34 |

TABLE 1-continued

| ELASTOMERIC MEMBER 52 | | | |
|---|---|---|---|
| "82" Dimension Inches | Compression Percent | Resistance Ohms | Remarks |
| .139-.163 | 32.8 | <0.00 | No shorts between terminals 32 and 34 |

Table I has four columns, with the first showing the variable values of dimension 82 obtained by the tightening of the nut and bolt arrangement of the test fixture 62 which, in turn, changed the amount of compression to which the elastomeric member 52 was subjected. The second, third and fourth columns respectively show the compression percentage to which the wires 54 of the elastomeric member 52 was subjected, the resistance value measured by the digital ohmmeter 84, and the pertinent remarks to somewhat explain each step of each run; e.g., the nut and bolt (70 & 72) arrangement was finger tight in the first step of each of Run I and Run 2 so as to yield a compression percent of 0.0.

Table 1 shows the parameters and results obtained from Run 1 and Run 2 and, in particular, each resistance value obtained for each step of each of Runs 1 and 2. The resistance was measured with a digital ohmmeter for each of the variable "82" dimensions given in Table 1. The lowest value that would register on the digital ohmmeter was five (5) milliohms and, therefore, all values now shown as being less than 0.00 ohms, where in actuality only known to be less than five (5) milliohms.

During the testing, it was determined that the monel wires 54 penetrated, with relative ease, the conformal coatings placed on turns 32 and 34. In addition, the capability of the monel wires 54 to penetrate more severe contamination was also tested. In particular, a torch was used to oxidize a standard printed wiring board material. Light finger pressure was then placed on the elastomeric member 52, and it caused the wires 54 to penetrate the oxidation and to provide good electrical continuity. A more severe test was attempted to evaluate the continuity provided by the wires 54 penetrating the surface of an anodized aluminum material. For such a surface, it was necessary to provide high contact pressure onto the wires, by the use of a "C" clamp arrangement, in order to have the monel wires penetrate the oxidized surface. Further, the ability of the elastomeric material, comprising the elastomeric member 52, to survive high temperatures was also analyzed. In particular, a flame of an acetlyne torch was applied to the elastomeric material and no visible degradation was observed.

It should now be appreciated that the present invention provides an elastomeric member 52 having pressure contact members in the form of compressible wires that allow an electrical interface to be interconnected, under compression, and that allows for an interface contact electrical resistance to be provided which is less than 5 milliohms at any of the interconnected terminals.

It should be further appreciated that the elastomeric member 52 because of its compressible nature and rubberized material provides a gas seal of the annular electrical terminals that are interconnected to each other. This seal may be visualized by merging the elements shown in FIGS. 2A and 2B so as to appreciate that elastomeric material of element 52 will form a depressible seal for the interconnected terminals that is not penetrated by gas. Furthermore, this elastomeric member 52 provides good electrical contact even in the presence of contaminates, such as smoke involved in the use of the separable connectors 10 that are responsive to pyrotechnic devices.

Although the previously given description was related to the use of the separable connector 10 with impulse devices, it should be realized that the separable connector 10 may find use in many applications that are devoid of such impulse devices. The separable connector 10 may be useful for all types of electrical mating of electrical terminals and all that is necessary is the compressible wires 54 be subjected to compression to provide very low resistant paths between the associated terminals.

In operation, and again with reference to FIG. 1, the present invention provides a separable connector 10 having solderless, pressure type contacts that yields low resistance, electrical connections between first and second electrical equipments. For such electrical connections, all that is necessary is that the first and second plates or printed wiring boards, carrying electrical terminals of the first and second equipment, respectively, be held and compressed together by compression means, generally indicated by elements 42A and 42B of connector 10. As long as the connector 10 keeps the two interfaces together under compression, low resistance electrical connections are provided. However, as soon as an impulse cartridge 44 receives an appropriate input, so as to generate a sudden outward force 44F, the first and second housings 38 and 40 of the connecter 10 are separated from each other, thereby, breaking the electrical connections between the interface 20, and in some cases, allowing the separable and dispensable equipment 14 to be expended while the permanent equipment 12 remains in an aircraft.

Many modification and variations of the present invention are possible in view of the above disclosure. It is therefore, to be understood, that within the scope of the appending claims, the inventions may be practiced otherwise as specifically described.

What we claim is:

1. A separable connector that provides solderless electrical connections between first and second electrical equipments, said separable connector comprising:

(a) first and second plates respectively carrying electrical terminals of said first and second electrical equipments;

(b) means for holding and compressing together the first and second plates and having a first cutout with predetermined dimensions, said holding and compressing means further having a means responsive to an impulse for releasing said holding and compressing of said first and second plates; and (c) a device inserted into said cutout and comprising elastic material and having a plurality of compressible conductive wires that are embedded in said elastic material, said conductive wires being spaced apart from each by a predetermined distance of about 0.035 inches and said wires are of a monel metal and include about 750 to about 900 wires per square inch, said conductive wires providing a plurality of electrical paths each having an electrical resistance of less than 5 milliohms between said terminals of said first and second electrical equipments when said first and second plates are being held and compressed together.

2. A separable connector according to claim 1, wherein said elastic material is silicone rubber 3. A separable connector according to claim 2, wherein said silicone rubber provides a gas seal when said first and second plates are being held and compressed together.

4. A separable connector that provides solderless electrical connections between first and second electrical equipments, said separable connector comprising:

a) first and second plates respectively carrying the electrical terminals of said first and second equipments;

b) means for holding and compressing together the first and second plates and having first cutout with a predetermined dimensions and a second cut-out with predetermined dimensions;

c) impulse means lodged in said second cutout and responsive to an input from a pyrotechnic device;

d) a device inserted into said first cutout comprising elastomeric material and having a plurality of compressible conductive wires that are embedded in said elastomeric material and that are spaced apart from each other by a predetermined distance, said compressible conductive wires providing the electrical paths between said terminals of said first and second electrical equipments when said first and second plates are held and compressed together, each of said electrical paths having an electrical resistance of less than 5 milliohms.

5. A separable connector according to claim 1, wherein said impulse is created by an explosion produced by a pyrotechnic device.

6. A separable connector that provides solderless electrical connections between first and second electrical equipments, said separable connector comprising:

a) first and second plates respectively carrying electrical terminals of said first and second electrical equipments, said electrical terminals being in the form of concentric rings that are disposed about a respective central region;

b) means for holding and compressing together the first and second plates so that concentric rings of said first plate are in alignment with said concentric rings of said second plate, said means for holding and compressing having a first cutout with predetermined dimensions and a second cutoff having predetermined dimensions and located in correspondence with said respective central regions of said first and second plates;

c) means responsive to an impulse and being inserted into said second cutout of said means for holding and compressing;

d) an elastic device inserted into said first cutout and having a central region removed therefrom to provide a space that is somewhat greater than and in alignment with said second cutout, said elastic device comprising an elastic material and having a plurality of compressible conductive wires that are embedded in said elastic material and that are spaced apart from each by a predetermined distance, said conductive wires providing the electrical path between said concentric terminals of said first and second equipments when said first and second plates are held and compressed together.

7. A separable connector according to claim 6, wherein said elastic material is silicone rubber and said compressible conductive wires are of a mortal metal.

8. A separable connector according to claim 6, wherein said silicone rubber provides a gas seal for said concentric terminals when said first and second plates are held and compressed together.

9. A separable connector according to claim 7, wherein said predetermined distance of said spaced apart mortal wires is about 0.035, and wherein about 750–900 monel wires per square inch are embedded in said elastic material, and wherein each of said electrical paths has an electrical resistance of less than 5 milliohms.

* * * * *